US008973174B2

(12) United States Patent
Palazzola

(10) Patent No.: US 8,973,174 B2
(45) Date of Patent: Mar. 10, 2015

(54) VENTED TOILET

(76) Inventor: Anthony Palazzola, Ortonville, MI (US)

( * ) Notice: Subject to any disclaimer, the term of this patent is extended or adjusted under 35 U.S.C. 154(b) by 164 days.

(21) Appl. No.: 12/924,538

(22) Filed: Sep. 29, 2010

(65) Prior Publication Data

US 2011/0078849 A1 Apr. 7, 2011

Related U.S. Application Data

(60) Provisional application No. 61/278,368, filed on Oct. 6, 2009.

(51) Int. Cl.
*E03D 9/04* (2006.01)
*E03D 9/052* (2006.01)

(52) U.S. Cl.
CPC ..... *E03D 9/052* (2013.01)
USPC ..... 4/216

(58) Field of Classification Search
USPC ..... 4/209 R, 213, 216
See application file for complete search history.

(56) References Cited

U.S. PATENT DOCUMENTS

| | | | | | |
|---|---|---|---|---|---|
| 2,124,017 | A | | 7/1938 | Vandiver | |
| 4,365,361 | A | * | 12/1982 | Sanstrom | 4/213 |
| 4,433,441 | A | * | 2/1984 | Schroeder | 4/213 |
| 4,748,698 | A | | 6/1988 | Kao | |
| 4,984,310 | A | | 1/1991 | Casale | |
| 5,590,423 | A | * | 1/1997 | Boykin | 4/213 |
| 5,727,263 | A | * | 3/1998 | Ceja Estrada | 4/216 |
| 5,809,581 | A | * | 9/1998 | Brown | 4/213 |
| 5,850,638 | A | * | 12/1998 | Her | 4/213 |
| 6,167,576 | B1 | | 1/2001 | Sollami | |
| 6,202,226 | B1 | | 3/2001 | Shoptaugh | |
| 6,209,146 | B1 | | 4/2001 | Gonzalez | |
| 6,237,163 | B1 | | 5/2001 | Guzzo et al. | |
| 6,260,215 | B1 | | 7/2001 | Miller | |
| 6,367,092 | B2 | * | 4/2002 | Cardwell et al. | 4/216 |
| 6,449,778 | B1 | | 9/2002 | Franco | |
| 6,496,986 | B1 | | 12/2002 | Lumsden | |
| 6,546,567 | B2 | | 4/2003 | Kuzniar | |
| 7,337,476 | B2 | | 3/2008 | Green | |
| 7,376,982 | B1 | * | 5/2008 | Pencheon | 4/213 |
| 7,424,752 | B2 | * | 9/2008 | Antoniou | 4/213 |
| 2002/0069455 | A1 | * | 6/2002 | Pottinger | 4/213 |
| 2002/0129441 | A1 | * | 9/2002 | Bassorelli | 4/213 |
| 2003/0070212 | A1 | | 4/2003 | Brodhead | |
| 2005/0138720 | A1 | * | 6/2005 | Shim | 4/213 |
| 2006/0021120 | A1 | * | 2/2006 | Nickle | 4/213 |
| 2006/0085898 | A1 | * | 4/2006 | Rosa | 4/213 |
| 2008/0216220 | A1 | * | 9/2008 | Markaj | 4/213 |

* cited by examiner

*Primary Examiner* — Janie Christiansen
(74) *Attorney, Agent, or Firm* — Raggio & Dinnin, P.C.

(57) ABSTRACT

A vented toilet system for use in a residential or commercial building. The vented toilet system comprises a toilet bowl and a vent cavity arranged adjacent to a top surface of the bowl. The system also comprises a water cavity arranged adjacent to and directly below the vent cavity. The system comprises a seat arranged on a top surface of the bowl and a toilet tank connected to the bowl. The system also comprises a wireless motion detection unit arranged adjacent to the toilet bowl, such that the operation of the vacuum pump is automatic. The wireless motion sensor may allow the vacuum pump to turn on immediately and remain on during duration of use of the toilet by the user. The vented toilet system also comprises a pipe or tube connected to the vent cavity, the pipe passes through either an existing wall or other structure to a vacuum pump and then to the outside of the structure in which the toilet is located.

11 Claims, 9 Drawing Sheets

VENTED TOILET

Continuation of U.S. Provisional Patent Application Ser. No. 61/278,368 Filed: Oct. 6, 2009

BACKGROUND OF THE INVENTION

1. Field of the Invention

The present invention generally relates to a vented toilet and more particularly relates to a toilet having a vented air-flow insert member arranged between a toilet seat and a toilet bowl surface, in order to evacuate toilet bowl odors by exhausting the odors to the outside of the building or room where the toilet is located.

2. Description of Related Art

Vented toilet seats and toilets are well known in the prior art. Accordingly, many devices have been developed to provide the function of removing fumes and odors from within a toilet. Some of these devices may include toilet bowls that have integrally formed vents, tanks with integrally formed vents, vented seats, suction devices for pumping air out, filters for cleaning the air and replacing it into the atmosphere of the toilet bowl, and many others also known in the art. Furthermore, a variety of products have been developed directed to masking or removing odors from a bathroom. Where there are multiple users of a bathroom or a commode, typically ceiling mounted ventilation systems are not adequate to remove odors in a sufficiently rapid manner. The prior art also has tried a variety of masking aerosol scents to render the odors less objectionable, however some persons find the use of air borne perfumes or scents objectionable in their own right and may exasperate allergy suffers and the like.

However, many of these solutions described above for controlling odors in a restroom or toilet are frequently inadequate because very large volumes of air in the room must be exhausted in order to dissipate odors that are actually concentrated in and about the toilet bowl. There have been a number of attempts to create devices which can remove or treat odors in and about the toilet bowl itself rather than the bathroom environment in general. However, many of these devices are large and bulky and generally not aesthetically pleasing to the users of the restrooms.

Therefore, there is a need in the art a vented toilet insert or vented toilet bowl. There also is a need in the art for low cost vented toilet insert that is capable of being quickly installed on existing toiletry hardware. There also is a need in the art for a vented toilet insert or toilet bowl that operates with the use of a wireless electronic motion detector to activate a vacuum pump or positive venting device during use of the toilet and a predetermined amount of time after the toilet has been vacated. There also is a need in the art for a vented toilet insert or vented toilet bowl that is capable of being used on new construction or installed in existing facilities. There also is a need in the art for a fully automatic and non evasive system to remove odors from a toilet bowl and the like.

SUMMARY OF THE INVENTION

One object of the present invention may be to provide a toilet bowl insert.

Another object of the present invention may be to provide a toilet bowl insert that provides an air flow system to remove toilet bowl odors by exhausting the odors to the outside of the building.

Still another object of the present invention may be to provide a toilet bowl insert that has a shape and contour that matches the contour of a toilet bowl that it is being installed on to maintain the aesthetic appearance of the toilet.

Yet a further object of the present invention may be to provide a toilet bowl insert that utilizes the same mounting holes as a standard toilet seat and also utilizes the same toilet seat bolts as those provided therein.

Still another object of the present invention may be to provide a toilet bowl with a toilet venting system that includes an exhaust vacuum pump that may be installed in the room ceiling, attic, utility service closet or other convenient location adjacent to the toilet.

Yet a further object of the present invention may be to provide a toilet bowl insert that is fully automatic and non evasive.

Yet another object of the present invention may be to provide a toilet bowl venting system that uses a wireless motion detector to turn a vacuum pump on and off during use of the toilet.

Still a further object of the present invention may be to provide a toilet bowl that will have air vent holes as an integral part of the ceramic bowl with a separate air chamber arranged within the toilet bowl.

Yet a further object of the present invention may be to provide a toilet bowl insert that is arranged between a toilet bowl top surface and a toilet seat and that has a plurality of vent holes arranged therein for evacuating odors from the toilet bowl and surrounding area.

Still another object of the present invention may be to provide a toilet bowl venting system that allows for fresh air to be passed through the toilet bowl insert and toilet bowl.

According to the present invention, the foregoing and other objects and advantages are obtained by a novel design for a toilet bowl insert or integrally vented toilet bowl for use in a bathroom in either a commercial or residential building. The toilet venting system includes a vented insert member which is arranged between an existing toilet seat and a top surface of an existing toilet bowl. The insert includes an evacuation channel or cavity arranged between two surfaces thereof. The bottom surface of the insert includes a plurality of orifices therein, which creates vents and allows for air to be evacuated through the cavity or channel in the interior of the insert and then through a predetermined portion of the insert into an exhaust system. The exhaust system includes a pipe located on the right or left side of the insert which is passed through either an existing wall or other structure to a vacuum pump and then to the outside of the structure in which the toilet is located. The toilet venting system includes a motion sensor arranged adjacent to the toilet such that the operation of the vacuum pump is automatic. The system also includes wireless operation of the motion sensor in conjunction with the vacuum pump. The wireless motion sensor will allow the vacuum pump to turn on immediately and remain on during duration of use of the toilet by the user.

One advantage of the present invention may be that it provides for an improved toilet venting system.

A further advantage of the present invention may be that it provides for a toilet venting system for use in a toilet that uses an insert arranged between a toilet seat and an existing toilet bowl.

Still a further advantage of the present invention may be that it provides for a toilet venting system that includes air vent orifices arranged within the ceramic portion of a toilet bowl.

Yet a further advantage of the present invention may be that it provides a toilet bowl insert that has a channel or cavity arranged between two surfaces thereof and a plurality of vent orifices arranged near a bottom surface thereof for evacuating odors from a toilet bowl during use.

Still another advantage of the present invention may be that the toilet bowl insert may be connected on either a left hand or right hand side thereof depending on the design requirements and the environment in which the toilet is arranged in the room.

Still another advantage of the present invention may be that it provides for utilization of the same mounting holes as a standard toilet seat and also utilizes the same toilet seat bolts to secure the insert to the toilet bowl and toilet seat.

Yet another advantage of the present invention may be that it provides for the use of a wireless motion detection system to operate the vacuum pump which is connected via standard plumbing pipe to the insert on either the left hand or right hand portion of the insert.

Still another advantage of the present invention may be that it provides for automatic and non evasive use wherein the vacuum pump will turn on immediately when a person comes in proximity to the toilet bowl and remains on during duration of use of the toilet.

Still another advantage of the present invention may be it provides for a low cost and easy to install toilet venting system for use in a toilet bowl or as a toilet insert.

Yet another advantage of the present invention may be that it provides a toilet venting system that has fewer parts and does not include bulky equipment such as some venting systems known in the prior art.

Still another advantage of the present invention may be that the toilet insert venting holes may be incorporated into a ceramic toilet bowl such that the venting insert is not necessary in the toilet venting system.

Other objects, features and advantages of the present invention will become apparent from the subsequent description and appended claims, taken in conjunction with the accompanying drawings.

BRIEF DESCRIPTION OF THE EMBODIMENT(S)

Figure 1:
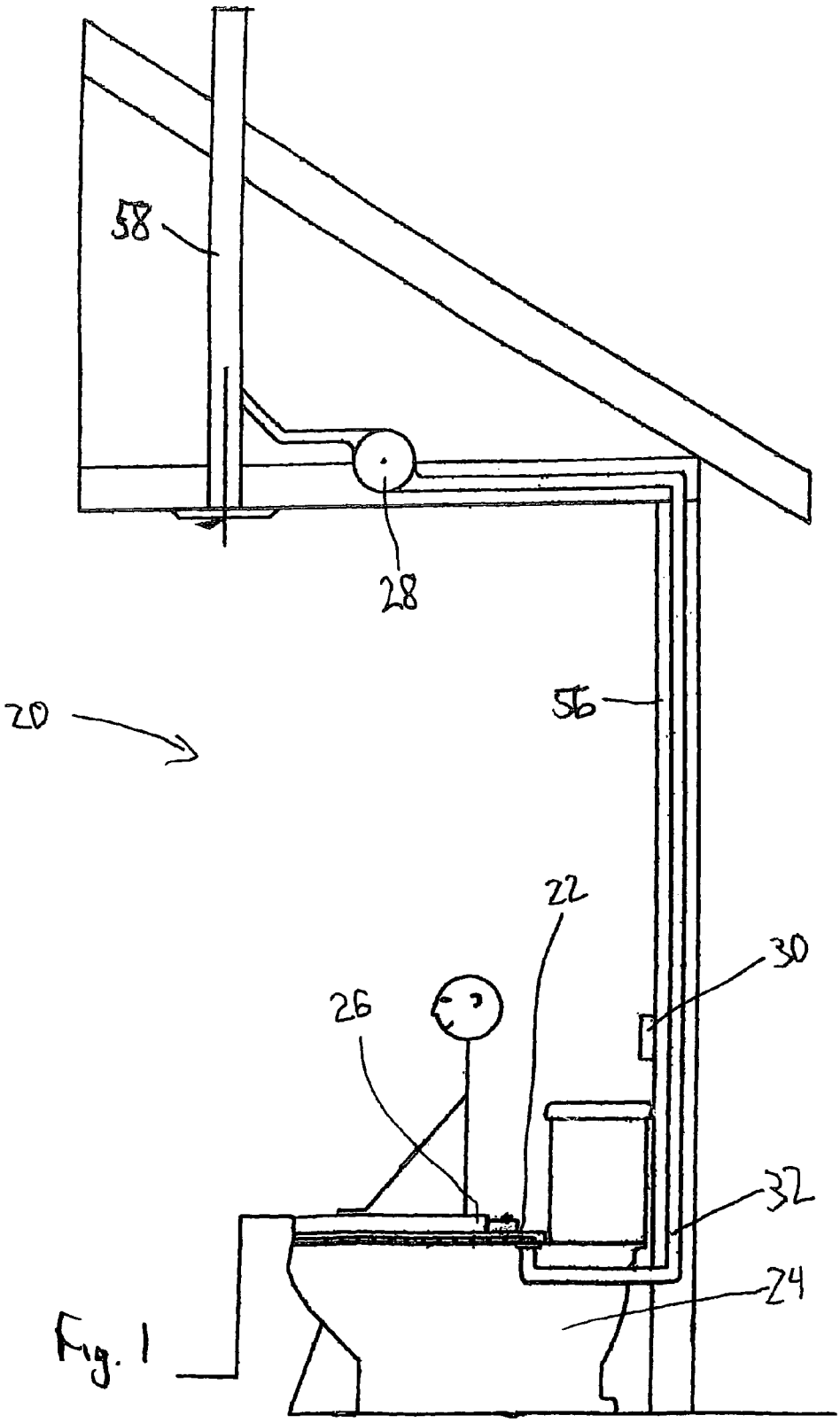
FIG. 1 shows a plan view of a toilet venting system according to the present invention.
Figure 2:
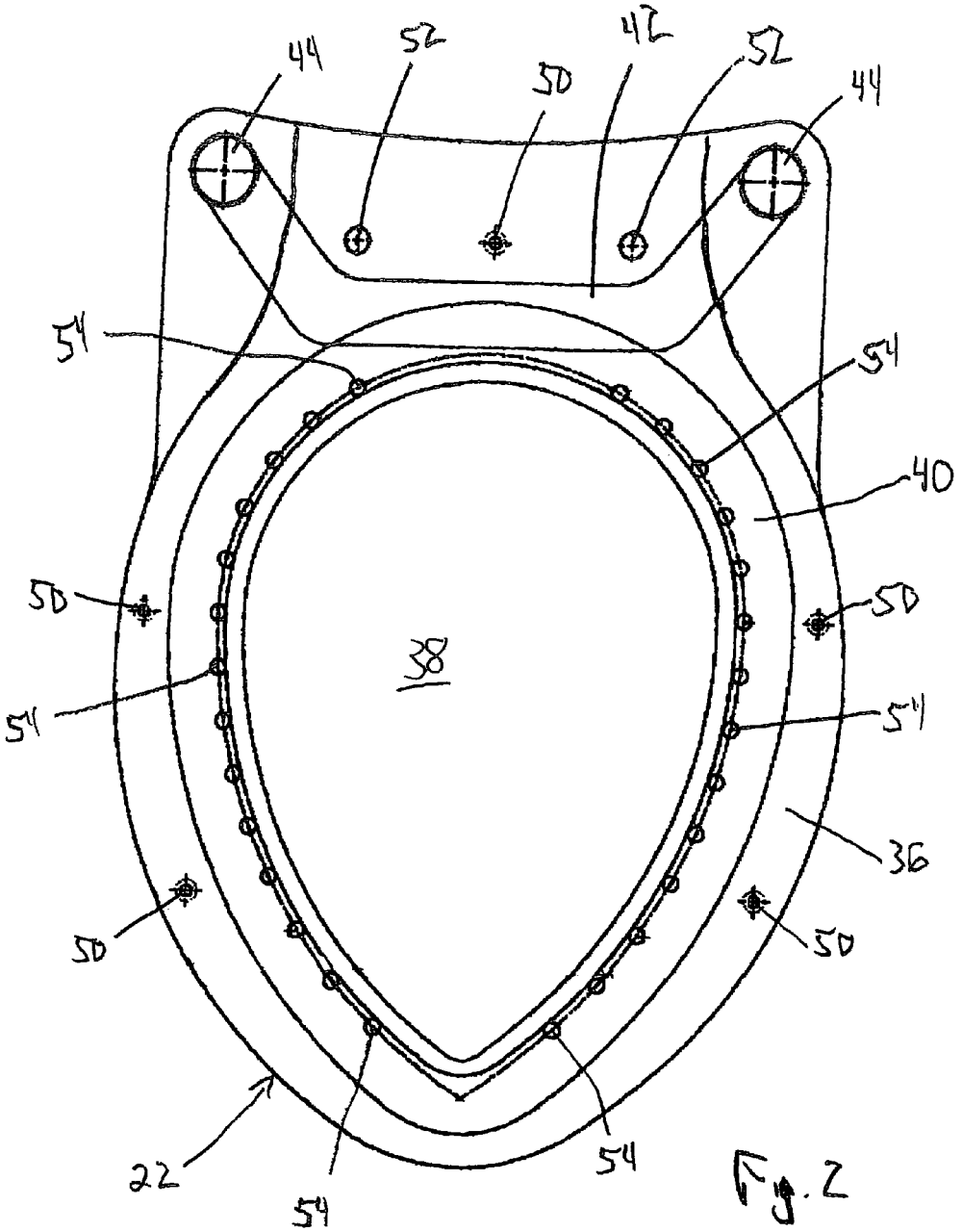
FIG. 2 shows a bottom portion of a toilet insert for use in the toilet venting system according to the present invention.
Figure 3:
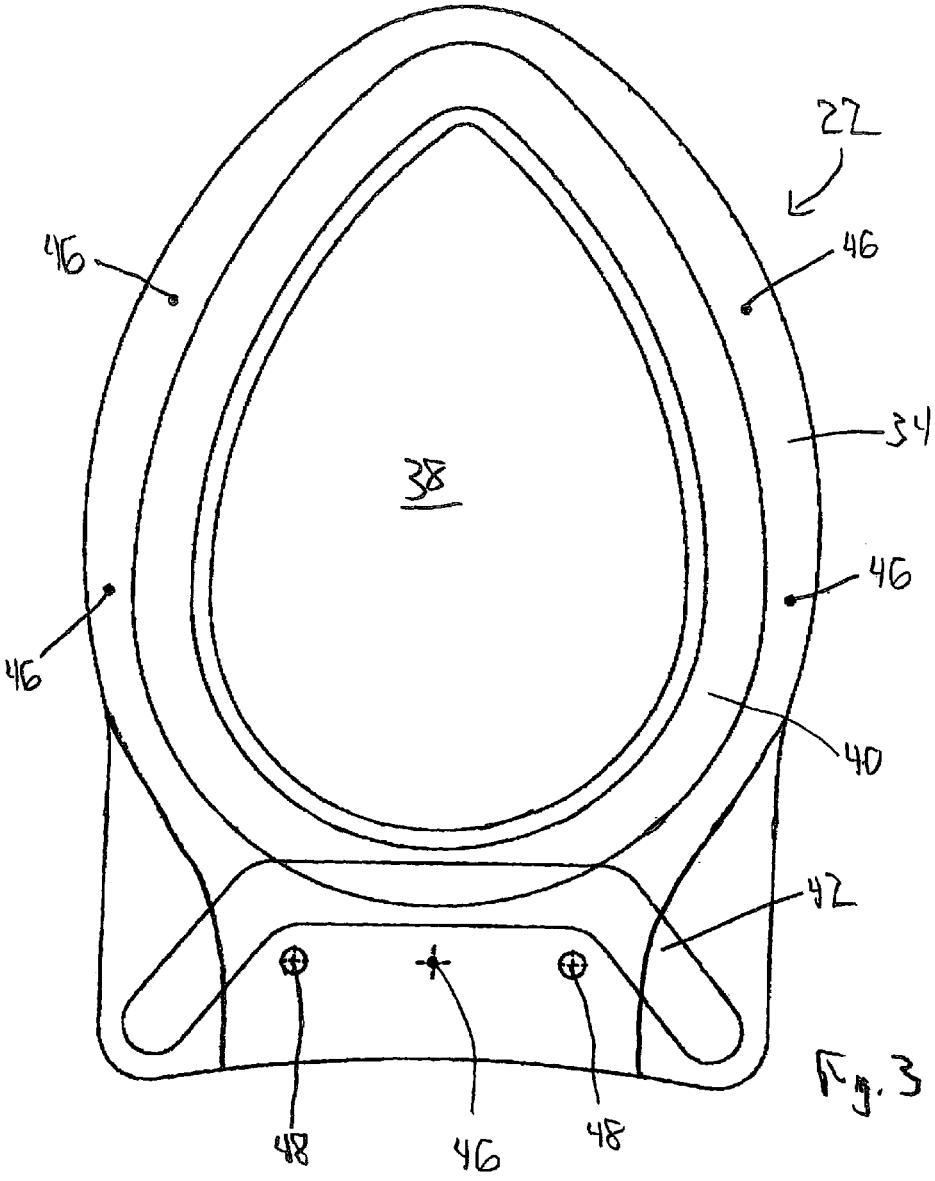
FIG. 3 shows a top portion of the toilet insert according to the present invention.
Figure 4:
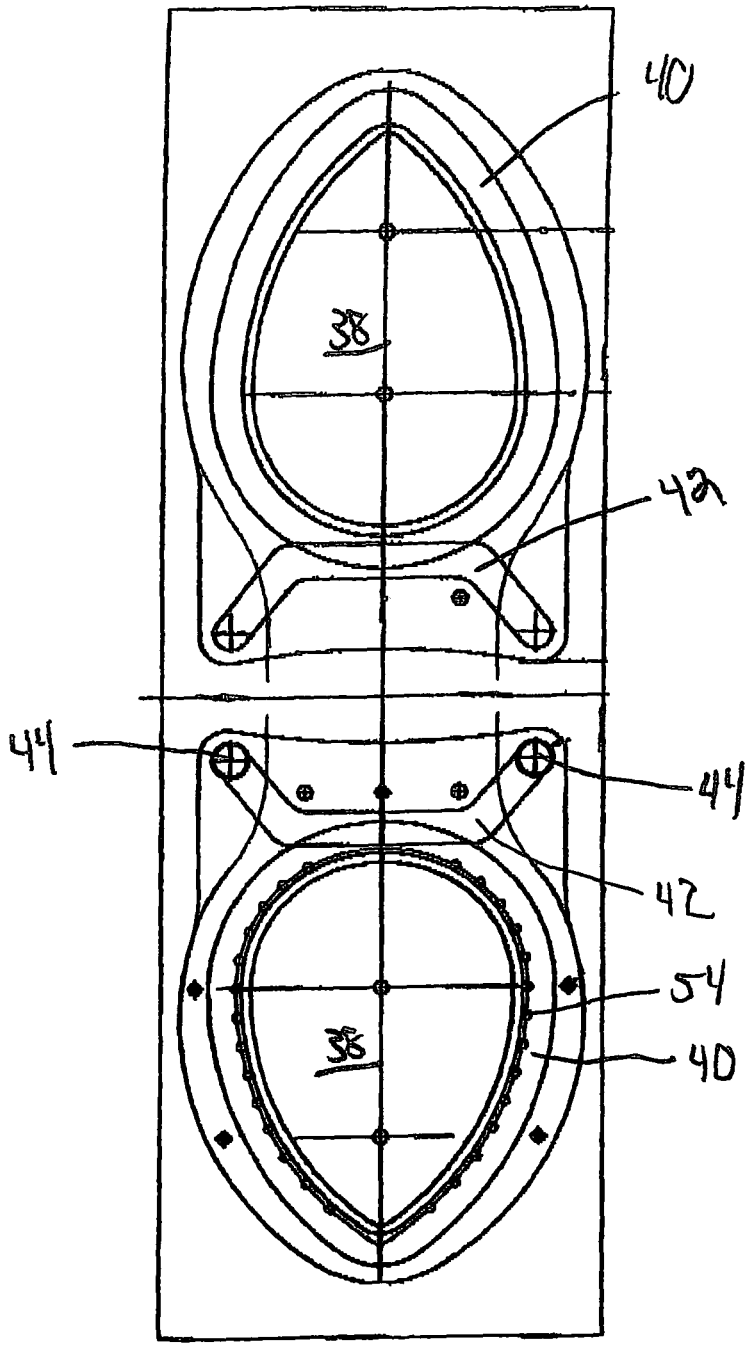
FIG. 4 shows a top and bottom view of a toilet insert according to the present invention.
Figure 5:
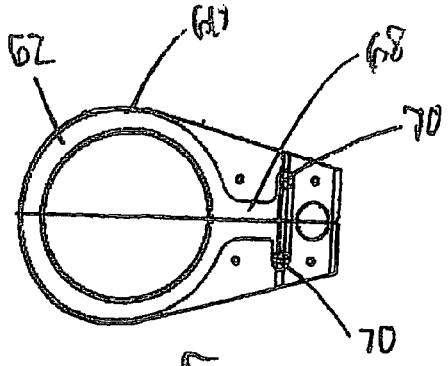
FIG. 5 shows a top view of a toilet bowl according to an alternate embodiment of a toilet venting system according to the present invention.
Figure 6:
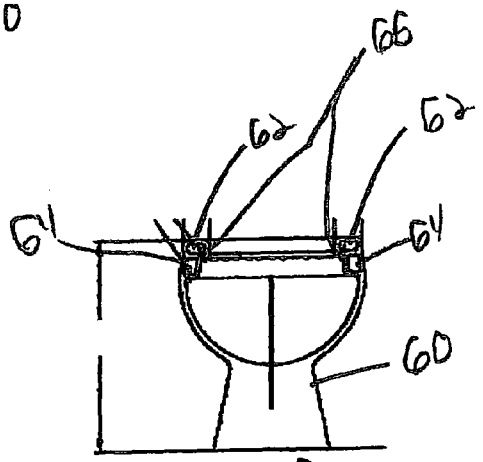
FIG. 6 shows a cross sectional view of the toilet bowl of FIG. 5.
Figure 7:
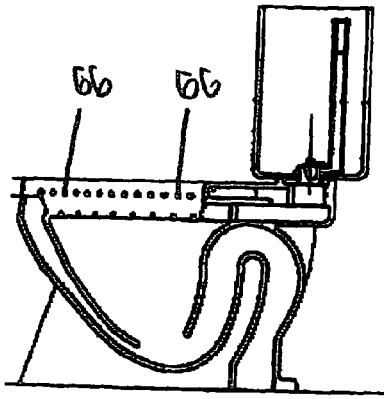
FIG. 7 shows a cross sectional view of a toilet bowl according to FIG. 5.
Figure 8:
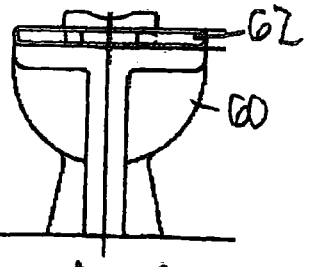
FIG. 8 shows a cross sectional view of a toilet bowl according to FIG. 5.

Referring to the drawings, there is shown a toilet venting system 20 according to an embodiment of the present invention. Generally, the present invention provides a toilet venting system 20 for use on any existing toilet structure or new construction toilet structure in either residential or commercial settings. The toilet venting system 20 allows for odors emanating from the toilet bowl to be evacuated, moved or vented to the air outside of the room or building in which the toilet is arranged. The toilet venting system 20 of the present invention provides a simple, easy to use and low cost air flow system to remove toilet bowl odors by exhausting the odors to the outside of the building or room in which the toilet is arranged. The shape and contour of a toilet insert 22 is designed to match the contour of the toilet bowl 24 and toilet seat 26 to maintain an aesthetic appearance for the toilet bowl 24 and toilet seat 26 when viewed by the using public. The use of the toilet venting system 20 may allow for the exhausting and venting of any toilet odors out of the confined bathroom before the odors escape into the room or into any adjacent occupied rooms in either a private, residential or commercial setting. It should be noted that the toilet 24 can be used in any known residential or commercial building or even in vehicles such as boats and motor homes that have bathroom facilities thereon. Furthermore, the toilet venting system 20 of the present invention is fully automatic and non evasive. A toilet 24 equipped with the insert member 22 of the present invention will allow for a vacuum pump 28 to turn on immediately via a wireless motion detection unit 30 arranged adjacent to or near the toilet 24 and will remain on during the duration of use of the toilet 24. The use of the toilet venting system 20 of the present invention will allow cool, fresh air from inside the room to pass through the toilet bowl 24 and exhaust or vent out of the room or building, via the toilet insert member 22, into a vent or pipe 32 either existing in the room or added into the room and connected to the toilet insert 22 on either a left hand or right hand side of the toilet insert 22. The toilet venting system 20 of the present invention is ideal for existing toilets or for remodeling of existing facilities and also for use in new construction of both residential and commercial buildings.

In the embodiment shown in FIGS. 1 through 4, the toilet venting system 20 comprises an airflow insert member 22 arranged between an existing toilet seat 26 and an existing toilet bowl 24. The insert member 22 generally has and mimics the shape of the toilet bowl 24 and a portion of the toilet seat 26 so as to be aesthetically pleasing to the users of the toilet. Therefore, the insert member 22 may have any known shape including but not limited to standard toilet bowls generally circular shape or even have a horseshoe shape as found in some bathrooms in the prior art. The insert member 22 in one contemplated embodiment is made of two pieces. A top piece or portion 34 and bottom piece or portion 36 wherein the two pieces are connected via any known connecting methodology including but not limited to gluing, welding, fasteners or any other known mechanical or chemical fastening methodology. It should also be noted that it is contemplated to mold, form or shape the insert member 22 as a one piece unit via any known molding or forming technology using any known material such as high density polymers, plastics, ceramics, composites, metals, natural materials or any other known material that is capable of being formed, molded, or shaped into the required insert member shape that will follow the contours and general shape of a toilet bowl 24 on which the air flow insert member 22 is attached thereto. The insert member 22 may have an orifice 38 therethrough which generally matches or mates with the toilet bowl opening. This opening 38 in the middle of the insert member 22 allows for use of the toilet seat 26 on a top surface of the top portion 34 of the insert member 22. The insert member 22 may have a hollow cavity 40 arranged around the entire circumference thereof. The cavity 40 may generally have an oval or circular like shape depending on the shape of the toilet bowl 24 on which the insert member 22 is arranged. In the embodiment shown one half of the cavity 40 is formed into the bottom portion 36 of the insert member 22 while the other half of the cavity 40 is formed into the top portion 34 of the insert member 22. The cavity 40 interacts with and is in communication with an exit channel 42 which extends from a predetermined portion of the cavity 40 to a first and second exit orifice 44 arranged near a back end of the insert member 22. The use of a first and second exit orifice 44 on the insert member bottom portion 36 allows for the necessary plumbing pipes or tubes 32 to be connected in either a left hand or right hand portion of the toilet 24 depending on the design requirements and environment in which the toilet 24 is used. It is also contemplated to connect dual pipe or vents to the air flow insert member 22 in another contemplated embodiment. It should be noted that if only one pipe 32 is connected to the air flow insert member 22 for evacuating and venting odors therefrom, the other exit orifice 44 may be plugged with a standard or custom made plumbing plug, insert or the like. It should be noted that the exit orifices 44 in one contemplated embodiment will be threaded to easily accept a threaded plumbing connector or pipe 32 or they may have smooth orifices that have other connecting methodologies used therein.

As shown in the embodiment the top portion of the insert member 22 may include a plurality of threaded orifices 46 that extend a predetermined distance into the top portion 34 of the insert member 22. These orifices 46 may be arranged in any known pattern through the inside surface a predetermined distance such that they do not break through the outer surface of the top portion 34 of the insert member 22. These orifices 46 may be used to have a fastener arranged therein to secure the bottom portion 36 to the top portion 34 of the insert member 22 to create the full insert member 22 before insertion onto a toilet bowl 24. As noted above, any other known connecting methodology may be used to connect the bottom portion 36 to the top portion 34 or the insert member 22 may be formed as a single unit. The top portion 34 has the cavity 40 around the circumference thereof, and also has the exit channel 42 in communication with the cavity 40 such that the odors will be directed to the exit orifices 44 in the bottom portion 36 of the insert member 22. The top portion 36 also may include a first and second connecting orifice 48 arranged at predetermined positions such that they match and utilize the same mounting holes as a standard toilet seat 28 utilizes on a standard toilet bowl 24. This allows for the toilet seat bolts to be passed through the insert member 22 and the toilet seat 26 to allow for securing of both the insert member 22 and toilet seat 26 to the top surface of the toilet bowl 24.

The bottom portion 36 of the insert member 22 according to the present invention may also include a cavity 40 arranged around the circumference of the insert member 22 and an exit channel 42 in communication with the cavity 40. The bottom portion 36 also includes the exit orifices 44 arranged through a surface thereof. The bottom portion 36 may also include orifices 50 that mate with and align with the orifices 46 on the top portion 34 to allow for fasteners to pass through the bottom portion 36 into the top portion 34 to secure the bottom portion 36 to the top portion 34. In the embodiment shown five orifices 50 are used with one arranged near a back portion and two arranged near each side. However, any other number of orifices 50 arranged in any known pattern may be used to connect the bottom portion 36 to the top portion 34 of the insert member 22 according to the present invention. The bottom portion 36 also may include connecting orifices 52 that align and mate with the connecting orifices 48 through the top portion 34 to allow for passing through of toilet seat bolts to secure the insert member 22 between the toilet seat 26 and toilet bowl 24. It should be noted that the connecting orifices 52 of the insert member 22 may be of any known shape or size, but generally are approximately one half inch in diameter to match the half inch holes in standard toilet bowls. It should be noted that the cavity 40 and exit channel 42 on both the bottom portion and top portion may have a predetermined depth, along with a predetermined thickness for the insert member 22 depending on the design requirements and the toilet bowl 24 in which they are used. In one contemplated embodiment the insert member 22 can be between a half inch thick to multiple inches thick depending on the toilet and the design requirements required of the toilet bowl and toilet seat. Generally, the outer top and bottom surfaces of the insert 22 are flat so the insert 22 lays flat against the toilet bowl upper surface and flat against the lower surface of the toilet seat 26. However, contours may be built into the outer surfaces for an aesthetic appeal to users of the toilet. The bottom portion 36 also may include a plurality of vent holes or orifices 54 through a predetermined portion of the cavity 40 through the outer surface of the bottom portion 36 of the insert member 22. The vent holes 54 are arranged in a predetermined pattern generally along an inside edge of the cavity 40 in the bottom portion of the insert member 22. However, the vent holes 54 may be arranged in any portion of the cavity 40 of the bottom portion 36 or in any other surface of the bottom portion 36 or even the top portion 34 of the insert member 22 depending on the design requirements of the toilet venting system 20. In the embodiment shown the orifices 54 generally are of a circular shape, however any other shaped orifice, slot, hole, or any other type of vent mechanism may be used to create the necessary pass through for air and odors from the toilet bowl 24 into the cavity 40 and exit channel 42 of the insert member 22. It should be noted that any number of orifices or vent orifices 54 may be arranged through the bottom portion 36 of the insert member 22 and they may be arranged in any known pattern and may also be capable of being selectively closed and opened depending on the design requirements of the insert member 22.

The exit channel 42 generally may have a U-shaped when viewed from a bottom or top thereof. However, any other shaped exit channel 42 may be used depending on the location and position of the exit orifices 44 through the bottom or top portion of the insert member 22. A predetermined portion of the exit channel 42 mates with and combines with a predetermined portion of the cavity 40 surrounding the body of the insert member 22. This will allow for the odors to be passed from the cavity 40 into the exit channel 42 and then into the exit orifice 44 via a vacuum pump 28 connected to piping 32 connected to one of the exit orifices. Therefore any known shape may be used for both the cavity 40 and exit channel 42 in the bottom portion and top portion of the insert member 22. In the embodiment shown, a generally half circle, semi circle like shape is used for the cavity 40 and exit channel 40 of the top portion and bottom portion of the insert member 22. However, any other shaped cavity 40 and exit channel 42 may be used within the scope of the present invention. Arranged at each end of the exit channel 42 are exit orifices 44 as described above. In one contemplated embodiment the exit orifices 44 are threaded and generally circular in shape. However, any other shaped orifice along with any other type of surface, i.e., threaded, not threaded, smooth, scored, etc., may be used to create the exit orifices 44 through the bottom portion 36 of the insert member 22. It is also contemplated to have the exit orifices 44 pass through an end surface of the bottom and top portion of the insert member 22.

The venting system 20 also includes a tube or pipe 32 that is connected to either one or both of the exit orifices 44 on a bottom portion 36 of the insert member 22 on one end thereof and to a vacuum pump 28 on an opposite end thereof. The vacuum pump results in a positive forceful displacement of air and odor because a certain amount of cubic feet of air is forcefully extracted from the room picking up the toilet bowl odors as the air is forced and directed to the venting stack. In the embodiment shown the pipe 32 is connected to the left exit orifice while the right exit orifice is plugged with any standard plumbing plug or any other known plug or cap member. The pipe or tube 32 may either be inserted in a wall 56 adjacent to the toilet 24 or run on the inside of the room in any known configuration either hidden by a box or out in the open depending on the design requirements. It should also be noted that the piping 32 may be placed through the floor and does not always have to be exhausted to a ceiling or top portion of the building in which the toilet 24 is arranged. It should be noted that existing vent stacks 58 or the like may be connected to the pipe 32 connected to the insert member 22 according to the present invention to allow for exhausting of odor from the toilet bowl 24. A vacuum pump 28 is connected at the opposite end of the pipe 32 and allows for evacuation of odors from the toilet bowl 24 via suction of air from the inner portion of the bathroom through the toilet bowl 24 and then through the insert member 22 and then through the pipe 32 into an existing vent stack 58 or other stack that has been created to vent the fumes to the outside of the building or structure in which the toilet 24 is arranged. In one contemplated embodiment as shown, the vacuum pump 28 may be connected to an existing ceiling fan, vent stack 58 or a separate vent stack may be vented to the outside of the building depending on the design requirements and the environment in which the toilet venting system 20 will be used.

The toilet venting system 20 also includes a wireless motion sensor 32 which is arranged adjacent to or near the toilet 24 in which the venting system 20 is attached. The motion sensor 30 is wireless and will send an electronic signal in the air to a control unit in to the vacuum pump 28. This signal will turn the vacuum pump 28 on and off when a person comes into close proximity to the toilet 24, either by standing in front of the toilet or sitting on the toilet during use of the toilet in the bathroom. The motion sensor 30 will keep the vacuum pump 28 on as long as it senses a person in close proximity to the toilet and may even have control software that allows for the pump fan to stay on a predetermined amount of time after a person leaves the bathroom to ensure complete evacuation of odors from the toilet bowl 24. However, it is also contemplated that once the person gets up from sitting on the toilet or from standing in front of the toilet the vacuum pump 28 will stop while that person is washing their hands or doing other business within the restroom. It is also contemplated to have a manual switch to allow for the person to keep the vacuum pump 28 on even after leaving the room. It should also be noted that any other type of wireless or wired motion system may be used in conjunction with the present invention, however a wireless motion sensor is preferred for use in order to reduce the need of hard wiring the system to the electrical system of the building and vacuum pump 28. With the embodiment as shown, the motion sensor 30 can be its own independent unit that just sends a signal to the vacuum pump 28 which has a receiver therein to control use of the vacuum pump 28 without any hard wiring between the motion sensor 30 and the vacuum pump 28 or even the electrical system of the residential or commercial building in which the motion sensor 30 is being used. Therefore, a totally battery operated motion sensor and battery operated vacuum pump may be used. In one embodiment contemplated the exhaust vacuum pump 28 may be installed in the room ceiling, attic or utility service closet or any other convenient location that has a generally acceptable 110 volt 15 amp duplex outlet. This will allow for the pump or fan 28 to operate via the signal sent by the wireless motion sensor 30.

It should be noted that during installation the insert member 22 utilizes the same mounting holes as a standard toilet seat and also utilizes the same toilet seat bolts. No additional hardware needs to be used, thus reducing the costs and complexity of installation thereof. The insert member 22 also provides threaded holes for ease of plumbing and use of standard PVC fittings and pipes to exhaust the odors to the outside of the room or building via existing room vents, soil stack, basement window vents or via new vents that may need to be put in to vent the odors outside of the building. Furthermore, the two threaded exit orifices or holes 44 in the insert member 22, allow for flexibility to plumb the exhaust tubing 32 to a convenient wall to maintain an aesthetic appearance of the room thus allowing for more flexibility in use of the toilet venting system 20 with the present invention. Furthermore, it should be noted that tooling may be provided to mold the insert member as a one piece member or as two separate pieces as described above. Therefore, during use the insert member 22 may be placed on the top surface of the bowl such that the insert member 22 connecting orifices 48 are arranged over the toilet bowl seat bolts and then the toilet seat 26 is placed on the top surface of the toilet bowl insert member 22 and the nuts are used to secure the toilet seat bolts, thus securing both the toilet seat 26 and insert member 22 to the toilet bowl 24 at a predetermined position thus keeping the aesthetic look to the toilet bowl 24 and toilet seat 26 with the insert member 22 arranged therein in an inconspicuous manner.

Figure 9:
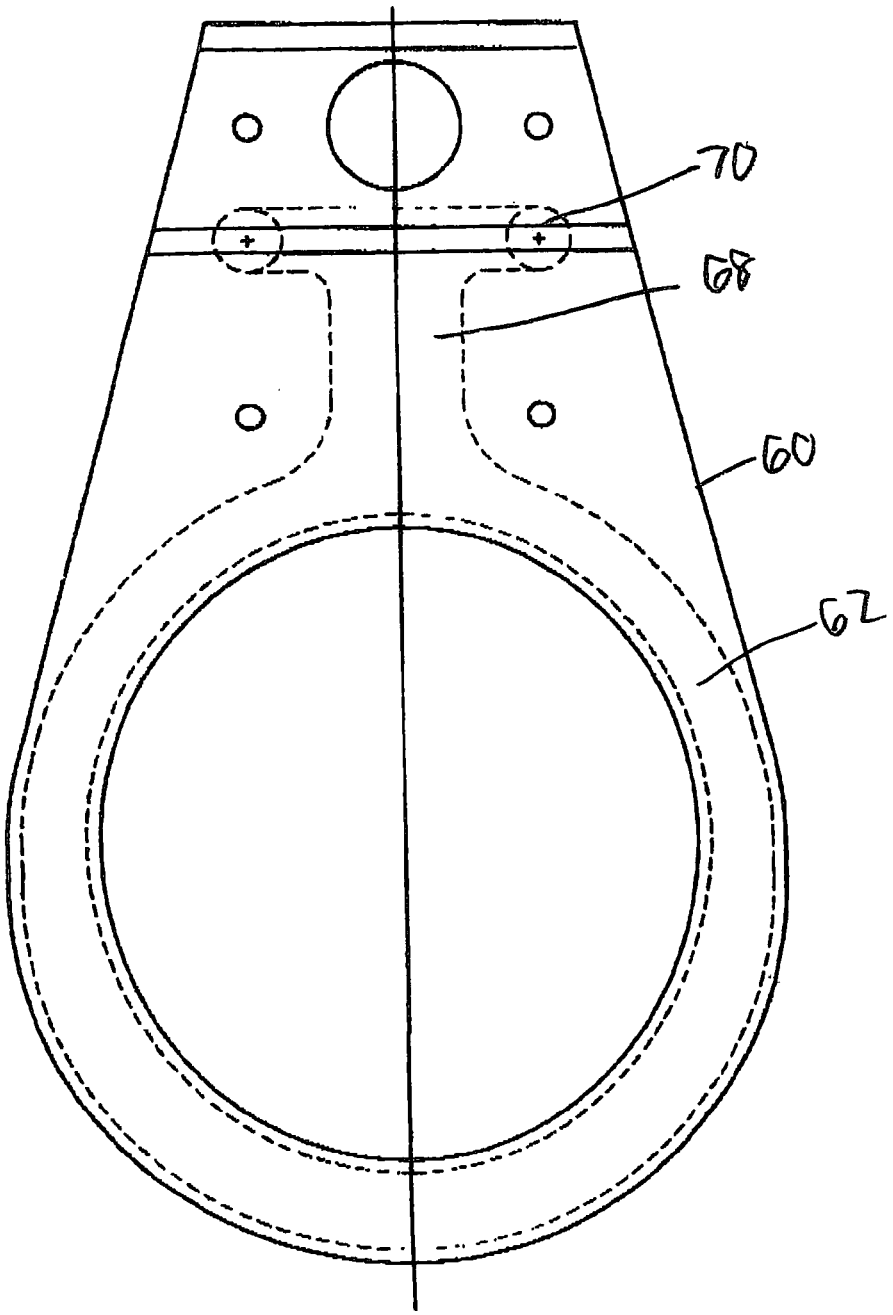
FIG. 9 shows a top view of a toilet bowl according to an alternate embodiment of the present invention.
Figure 10:
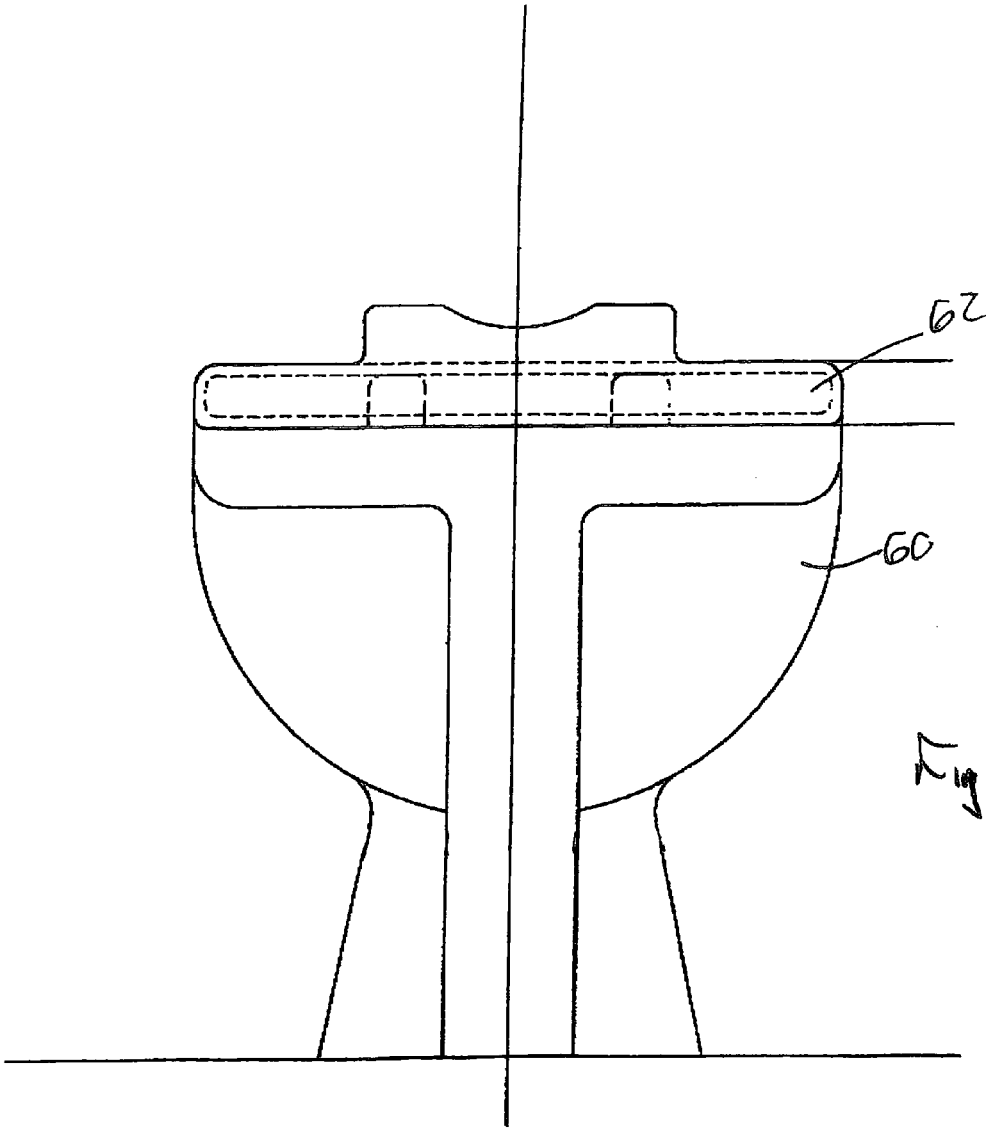
FIG. 10 shows a front view of a toilet bowl according to an alternate embodiment of the present invention.
Figure 11:
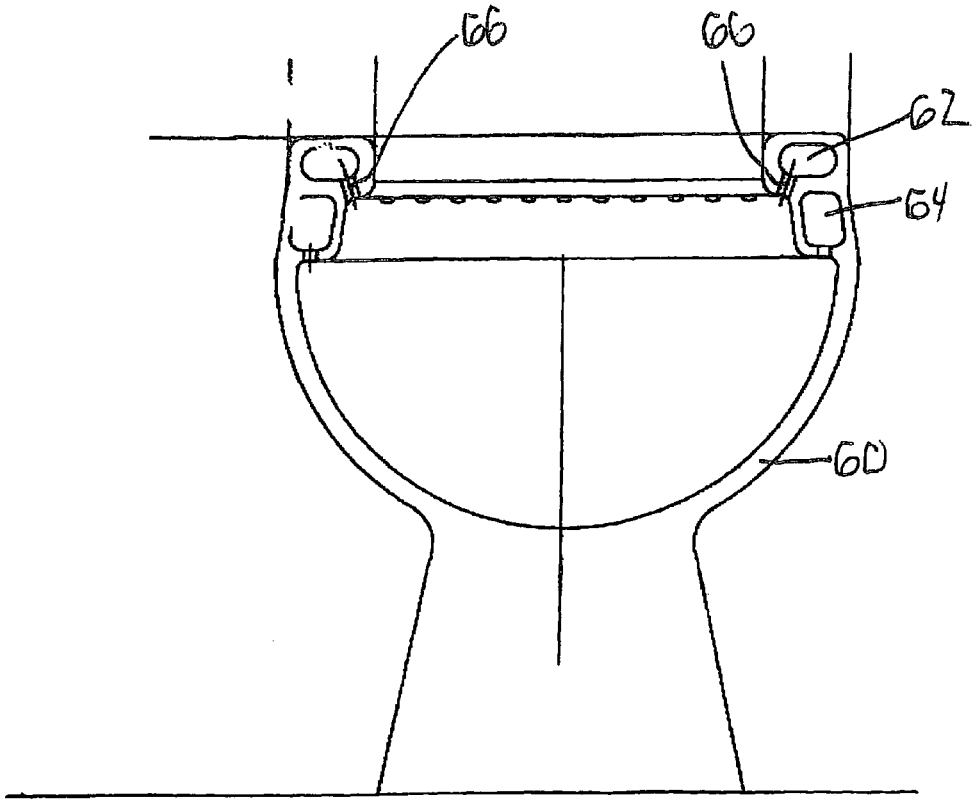
FIG. 11 shows a cross sectional view of a toilet bowl according to an alternate embodiment of the present invention.
Figure 12:
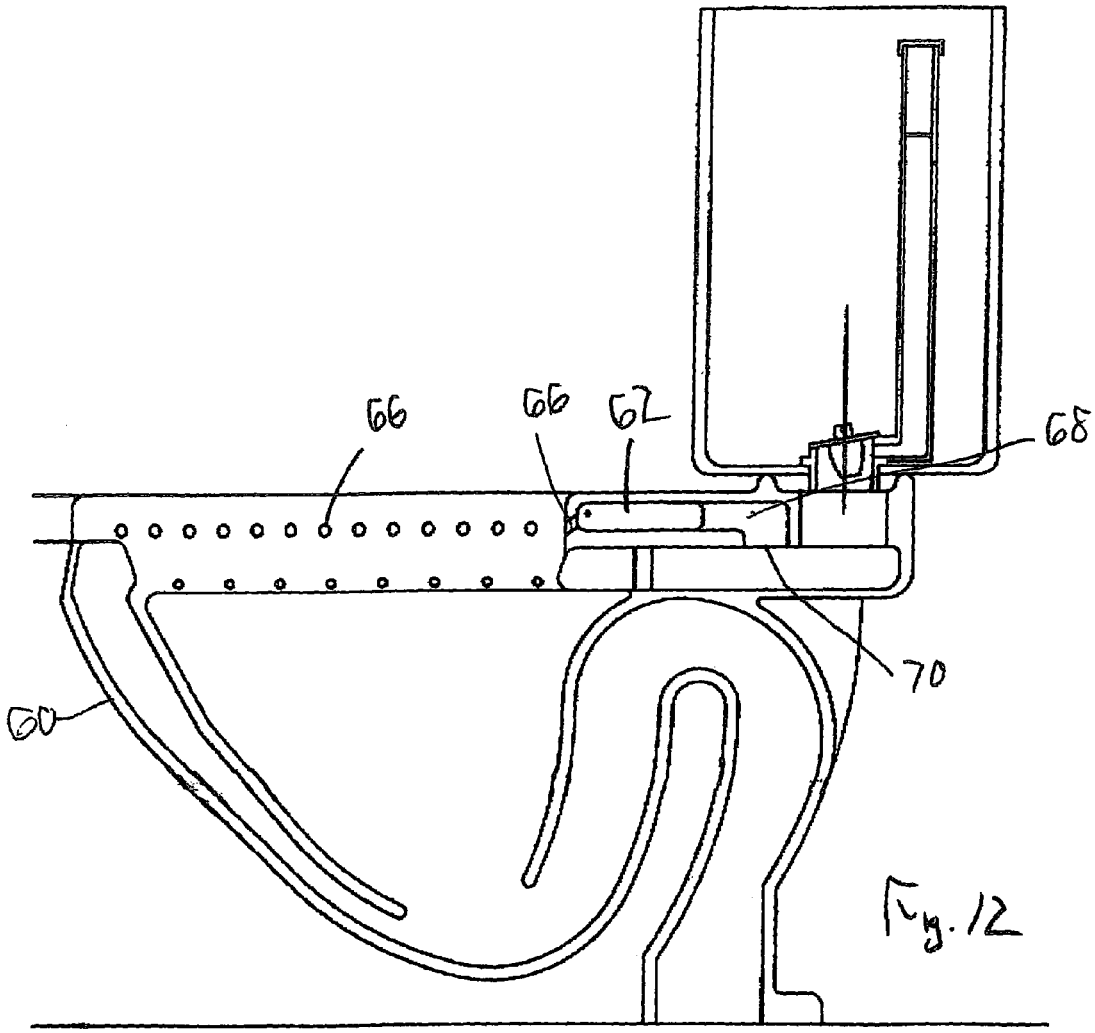
FIG. 12 shows a cross sectional view of a toilet bowl according to an alternate embodiment of the present invention.

An alternate embodiment of the toilet venting system 20 is shown in FIGS. 5 through 12. It should be noted that the connecting of this alternate embodiment toilet venting system 20 is the same as that as described above and will not be described herein. Generally, the alternate embodiment as shown in FIGS. 5 through 12, takes an insert member which is a separate unit as described above and incorporates it into the top portion of the ceramic toilet bowl 60. The embodiment shown includes a vent cavity 62 arranged along the upper outer periphery and top surface of the toilet bowl 68. The vent cavity 62 is arranged directly above and adjacent to the water cavity 64 and generally arranged near a top end of a toilet bowl 60. The water cavity 64 has water rushing through it and descends through a plurality of orifices onto the outer upper surface of the bowl to clean the bowl after use by a person. The vent cavity 62 may be directly adjacent to and above the water cavity 64. The vent cavity 62 in one contemplated embodiment generally has an oval shape, however any other shaped cavity may be used around the entire circumference of the upper portion of the toilet bowl 60. The vent cavity 62 may have a predetermined width and thickness depending on the size of the toilet bowl 60 being used. A plurality of vent holes or orifices 66 are arranged between the vent cavity 62 and the inner surface of the toilet bowl 60. In the embodiment shown the holes 66 generally may have a predetermined angle when viewed from a front as shown in FIG. 11. These vent holes 66 may be placed around the entire inner periphery of the toilet bowl 60, such that they are not visible to a user when viewing the toilet 60 from a top view thereof. It should be noted that the vent holes 60 may be of any known shape or size depending on the design requirements of the toilet 60. In the embodiment shown, circular shaped orifices or holes 66 are used. The venting cavity 62 is in communication with an exit channel 68 which includes a first and second exit orifice 70 arranged on either side of a bottom portion of the toilet bowl 60. The exit channel 68 may have any known shape, but the shape shown in FIG. 9 is generally a T-shape and extends from a predetermined back portion of the vent cavity 62. At each end of the T-shaped member for the exit channel 68 is arranged an exit orifice 70 having a predetermined diameter hole that may be threaded or not. Connected to each orifice 70 may be standard plumbing pipe as described above for evacuating the odors from the toilet 60 into the outside atmosphere. Therefore, as shown in FIGS. 5 through 12, a venting cavity 62 may be molded onto a top portion of the toilet bowl 60. This will allow for a toilet seat to be directly connected via well known toilet seat connecting holes and bolts to the top of the toilet bowl 60 while still allowing for evacuation of odors from the toilet 60 via a wireless motion sensor 30 and vacuum pump 28 as described above. The molding of the toilet bowl 60 includes the vent cavity 62 and exiting channel 68 thus not increasing the cost other than increased material costs. This will allow for complete integration of the air flow insert member into a toilet bowl 60 thus only requiring the necessary piping and vacuum pump to be connected to a vent stack or the like to complete the toilet venting system 20 according to the present invention. It should be noted that the air chamber or venting cavity 62 can be of any known shape and any known thickness depending on the toilet and the aesthetic look of the toilet necessary in the bathroom in which the toilet venting system 20 will be used. Therefore, any known shape, length or contours may be used for both the venting cavity 62 and exit channel 68 and exit orifices 70 through the surfaces of the toilet bowl 60 as shown in the drawings and as described above. No limitations should be read into how the air chamber 62 may be arranged on the top portion of the toilet bowl during manufacturing of the toilet bowl therein.

The present invention has been described in an illustrative manner. It is to be understood that the terminology which has been used is intended to be in the nature of words of description rather than that of limitation.

Many modifications and variations of the present invention are possible in light of the above teachings. Therefore, within the scope of the appended claims, the present invention may be practiced otherwise than as specifically described.

What is claimed is:

1. A vented toilet system, said system comprising:

a bowl;

a single continuous vent cavity formed integrally with said bowl and arranged adjacent to an entire top surface of said bowl;

a water cavity arranged adjacent to and directly below said vent cavity, said water cavity and said vent cavity generally overlap when viewed in profile;

a seat arranged on said top surface of said bowl;

a single exit channel extending between said vent cavity and a bottom surface of an upper back portion of said bowl;

a first and second exit orifice arranged from said exit channel;

a single tube connected to only one of said exit orifices; and a wireless motion detection unit arranged adjacent to or near said bowl.

2. The system of claim 1 further comprising a toilet tank connected to said bowl.

3. The system of claim 1 wherein said vent cavity having a generally oval or rectangular shape when viewed in cross section.

4. The system of claim 1 further comprising a plurality of vent orifices arranged between said vent cavity and an inner surface of said bowl, said vent orifices having a predetermined angle with relation to said bowl.

5. The system of claim 1 wherein said tube arranged between said exit channel on one end and a vacuum pump on an opposite end.

6. The system of claim 5 wherein said wireless motion detection unit is in communication with said vacuum pump, said vacuum pump is arranged near a ceiling fan or vent stack.

7. The system of claim 1 wherein said exit channel having a generally T-shape when viewed from above.

8. The system of claim 1, wherein said first exit orifice arranged on one side of said bottom surface of an upper back portion of said bowl, said second exit orifice arranged on another side of said bottom surface of an upper back portion of said bowl.

9. The system of claim 4 wherein said vent orifices are arranged at a predetermined angle with relation to said top surface of said bowl.

10. The system of claim 1 wherein said other of said exit orifices is plugged.

11. The system of claim 1 wherein said water cavity having a plurality of water orifices, said water orifices are perpendicular with said top surface of said bowl.

* * * * *